United States Patent [19]

Takayanagi

[11] Patent Number: 4,658,234

[45] Date of Patent: Apr. 14, 1987

[54] RESISTOR NETWORK

[75] Inventor: Katsumi Takayanagi, Miyagi, Japan

[73] Assignee: Alps Electric Co., Ltd., Japan

[21] Appl. No.: 742,214

[22] Filed: Jun. 6, 1985

[30] Foreign Application Priority Data

Jun. 6, 1984 [JP] Japan ..... 59-84038[U]
Jun. 6, 1984 [JP] Japan ..... 59-84037[U]

[51] Int. Cl.[4] ..... H01C 1/02; H01C 1/08; H01C 10/14

[52] U.S. Cl. ..... 338/260; 338/319; 338/320; 338/57

[58] Field of Search ..... 338/260, 295, 319, 320, 338/306–309, 325, 333, 53, 57, 58, 226, 243, 245, 249; 361/328, 274

[56] References Cited

U.S. PATENT DOCUMENTS 1,720,381 7/1929 Simpson ..... 338/57

FOREIGN PATENT DOCUMENTS 2624724 12/1977 Fed. Rep. of Germany ..... 361/328
2820153 9/1978 Fed. Rep. of Germany ..... 338/320

*Primary Examiner*—E. A. Goldberg
*Assistant Examiner*—Linda M. Peco
*Attorney, Agent, or Firm*—Guy W. Shoup

[57] ABSTRACT

A resistor network having resistor elements disposed equally spaced apart in parallel relation to each other and one or more insulation substrates to which the resistor elements are rigidly mounted. The substrates and the elements are all enclosed in a resin seal in the form of a belt. The resin seal is provided with one or more holes extending through it for dissipating heat. The holes are rectangular in shape, and are disposed between every two of the resistor elements or in other regular manner.

3 Claims, 4 Drawing Figures

RESISTOR NETWORK

FIELD OF THE INVENTION

The present invention relates to a resistor network and, more particularly, to a resistor network having a plurality of resistor elements which are disposed in parallel relation to each other and are not fabricated as a unit.

BACKGROUND OF THE INVENTION

Generally, resistor networks are composed of a plurality of resistor elements which are disposed in parallel and spaced apart a given distance from each other, an insulation substrate supporting the resistor elements, and a resin seal that encloses all the substrate and the resistor elements. Resistor networks of single in-line type have terminals all protruding in the same direction. Resistor networks of dual in-line type is divided into two for each resistor element, the two projecting in opposite directions.

In these conventional resistor networks, resistor elements are entirely sealed in a resin seal in the form of a belt. For this reason, the heat produced by the elements is not effectively dissipated in comparison with the thermal loss caused by them. Consequently, as such a resistor network is continuously used for extended periods, it may age, i.e., the performance of the whole network may deteriorate.

SUMMARY OF THE INVENTION

It is the main object of the present invention to provide a resistor network which is free of the foregoing difficulties with the conventional resistor networks and the performance of which is not deteriorated by heat.

The above and additional objects are achieved by a resistor network comprising a plurality of resistor elements that are equally spaced apart from each other and disposed in parallel relation to each other, an insulation substrate rigidly supporting the resistor elements, and a beltlike resin seal that encloses all the substrate and the resistor elements, the resistor network being characterized in that the resin seal is provided with one or more heat-dissipating holes which extend through the resin seal and are equally spaced apart from each other.

DETAILED DESCRIPTION OF THE INVENTION

Figure 1:
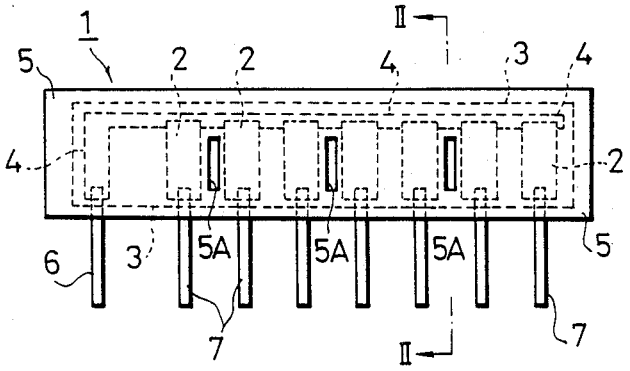
FIG. 1 is a front elevation of a resistor network according to the present invention.
Figure 2:
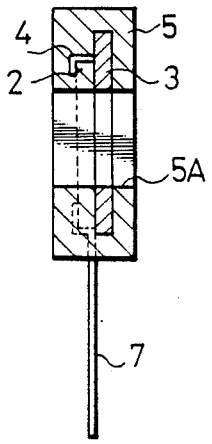
FIG. 2 is a cross-sectional view taken along line II—II of FIG. 1.

Referring to FIGS. 1 and 2, there is shown a single in-line type resistor network 1 according to the present invention. This network 1 has resistor elements 2 which are disposed in parallel with each other and equally spaced apart on a beltlike insulation substrate 3. A common continuous electrode 4 is electrically connected to each one end of all the resistor elements 2. The resistor elements 2 and the substrate 3 are entirely enclosed in a resin seal 5, which has been formed as by molding.

The resin seal 5 is provided with holes 5A extending through the seal 5 to dissipate heat. The holes 5A which take a rectangular form are so formed at regular intervals on the opposite side to the resistor elements 2 that each hole 5A lies between every two elements 2. The holes 5A may be replaced by dissipating holes (not shown) whose bottom portions reach the substrate 3. Thus, the heat generated around the substrate 3 is effectively dissipated. Protruding from the electrode 4 is a terminal 6 that is common to the resistor elements 2, which have their respective other terminals 7. The holes 5A or the alternative holes (not shown) have internal surfaces coated with wax or the like for keeping out moisture.

It is also possible to make the heat-dissipating holes 5A circular. It is to be noted that no specific limitations are imposed on the number of the holes 5A. For example, the holes 5A may be formed between every successive resistor element 2. Further, the holes 5A may be formed only near those resistor elements 2 which constitute large heat loads. Furthermore, the holes 5A may be formed near selected resistor elements of relatively large heat loads.

Figure 3:
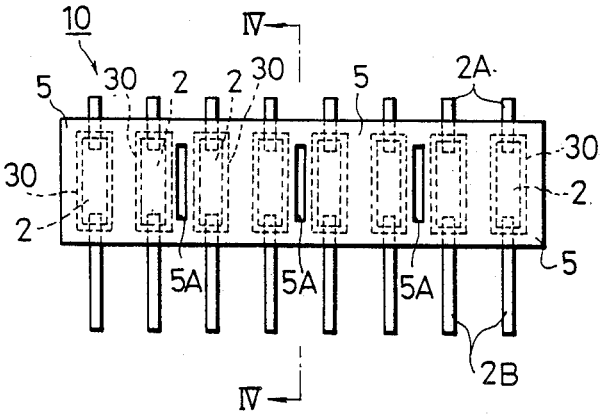
FIG. 3 is a front elevation of another resistor network according to the invention.
Figure 4:
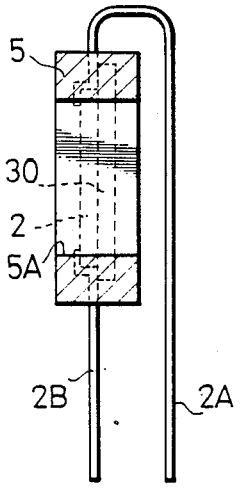
FIG. 4 is a cross-sectional view taken along the line IV—IV of 3.

Referring next to FIGS. 3 and 4, there is shown a dual in-line type resistor network 10 according to the invention. The network 10 has resistor elements 2 similar to those in the previous example. These resistor elements 2 are rigidly mounted to their respective insulation substrates 30 which are provided separately. Terminals 2A protrode from each one end of the resistor elements and are bent. Terminals 2B protrude from the other ends of the resistor elements. This resistor network is exactly the same as the network in the previous example except for the structure described just above. Hence, this second example of resistor network functions in the same way as the first example of resistor network.

As thus far described, the novel resistor network according to the present invention comprises a plurality of resistor elements that are equally spaced apart from each other and disposed in parallel relation to each other, an insulation substrate rigidly supporting the resistor elements, and a beltlike resin seal that encloses all the substrate and the resistor elements, the resin seal being provided with one or more heat-dissipating holes extending through the resin seal and spaced apart a given distance, the holes taking a rectangular form and formed between selected ones of the resistor elements. Thus, the heat generated around the substrate can be effectively dissipated by the action of the heat-dissipating holes, whereby sufficiently preventing deterioration of the resistor elements. Also, the holes extending through the resin seal are easy to machine. In this way, the novel network yields practical advantages including excellent durability.

What is claimed is:

1. In a resistor network having a plurality of resistor elements disposed in parallel spaced apart from each other in a longitudinal row in one plane, an insulation substrate supporting the resistor elements, and a resin sealing member enclosing the resistor elements and substrate.

the improvement wherein said resin sealing member is formed as a rectangular body elongated over said longitudinal row parallel to said one plane, and has a plurality of holes equally spaced apart and formed through said body and said substrate normal to said one plane between selected pairs of said resistor elements.

2. A resistor network according to claim 1, wherein said holes are disposed between resistor elements producing a large heat loading.

3. A resistor newtork according to claim 1, wherein said insulation substrate supporting said resistor elements is formed as a single planar sheet extending across said longitudinal row.

* * * * *